US009790678B2

(12) United States Patent
Character

(10) Patent No.: US 9,790,678 B2
(45) Date of Patent: Oct. 17, 2017

(54) CHECK VALVE FLOOR DRAIN

(71) Applicant: Alvin J. Character, Maple Heights, OH (US)

(72) Inventor: Alvin J. Character, Maple Heights, OH (US)

( * ) Notice: Subject to any disclaimer, the term of this patent is extended or adjusted under 35 U.S.C. 154(b) by 246 days.

(21) Appl. No.: 14/644,566

(22) Filed: Mar. 11, 2015

(65) Prior Publication Data

US 2016/0265673 A1 Sep. 15, 2016

(51) Int. Cl.
*F16K 15/18* (2006.01)
*E03F 7/04* (2006.01)
*E03F 5/04* (2006.01)

(52) U.S. Cl.
CPC ..... *E03F 7/04* (2013.01); *E03F 5/0407* (2013.01)

(58) Field of Classification Search
CPC ..... E03C 1/262; E03F 5/0407; E03F 7/04; Y10T 137/7504; Y10T 137/7436
USPC ..... 137/519.5, 454.2, 362; 4/255.08, 287, 4/682, 688
See application file for complete search history.

(56) References Cited

U.S. PATENT DOCUMENTS 1,721,746 A * 7/1929 Pearson ..... E03F 7/04 137/435
1,753,724 A * 4/1930 Shaw ..... E03F 5/042 137/433
2,003,770 A * 6/1935 Goodhart ..... E03F 5/042 137/433

* cited by examiner

*Primary Examiner* — Craig Schneider
*Assistant Examiner* — P. Macade Nichols
(74) *Attorney, Agent, or Firm* — Daniel M. Cohn; Howard M. Cohn

(57) ABSTRACT

A system and method for inserting removable drain valve within an inlet opening of a drain basin and then sealing the drain valve within the drain basin. The removable drain valve has a cylindrical housing with a check valve disposed with an outlet of the drain basin to allow drain water to flow out from the outlet of the drain basin while blocking flow from the outlet of the drain basin to the inlet of the drain basin. A cylindrical expander band having first and second ends spaced from each other is disposed about the cylindrical housing. A cylindrical gasket is mounted about the cylindrical housing and the cylindrical expander band. A paddle lock lever is pivotally mounted within the cylindrical housing. The paddle lock lever has an expander head to expand the cylindrical expander band and cause the cylindrical gasket to expand and seal against the drain basin.

20 Claims, 6 Drawing Sheets

CHECK VALVE FLOOR DRAIN

FIELD OF THE INVENTION

The present invention relates to a check valve floor drain and more particularly to a check valve floor drain adapted to be installed into a floor drain.

BACKGROUND OF THE INVENTION

In the developed world, sewers are usually pipelines that begin with connecting pipes from buildings to one or more levels of larger underground trunk mains, which transport the sewage to sewage treatment facilities. Sewers are generally gravity powered, though pumps may be used if necessary. Pipes conveying sewage or other water carried waste from an individual building to a common gravity sewer line are called laterals. Branch sewers typically run under streets receiving laterals from buildings along that street and discharge by gravity into trunk sewers at manholes.

When a sewage line from a building becomes clogged or overloaded, sewage within the line may back up and flood the inside of the building. Sewer water backing up into a building can cause a great deal of damage. The water can do serious damage and may require total remodeling if an area used for living is damaged. Sewer backup can be the result of a variety of causes, but whatever the cause, the results can be devastating. Therefore, there is a need for an emergency backflow system which can utilize a backflow system existing in a building.

It is customary in lower floors of buildings to provide a drain in the floor for conducting water or other liquids to the sewer. Frequently, water collects in basements as a result of washing the floor or seepage through the walls. The floor is usually built at a slope to allow the water to flow by gravity to the drain. The common drain consists of a cover plate having a plurality of holes to strain out solids and to allow the water to flow through to a bowl which is attached at the bottom to a drain line which connects to a sewer line. Such drains work satisfactorily for floors which are relatively high with relation to the main sewer line. In some cases, however, the sewer line may become overloaded or blocked causing water to back up in the drain line to such an extent that the floor becomes flooded.

Heretofore, various means have been used to prevent back up water from the sewer line to flow through the drain and onto the floor within the building. These prior art devices have often been unduly expensive or have certain disadvantages which make their safety and dependability uncertain. For example, a back water valves have been inserted in the pipe below the drain bowl. One such valve is a ball type mechanism which is forced by the backup water against the underside of the bowl to close the bowl opening. Also, a plug with a stem for inserting and removing has been forced into the drain pipe to close the pipe. Such back up water valves or plugs are not always dependable as solids may lodge between them and the pipe so that they do not seat properly or they become loose whereby their usefulness is impaired.

Currently, the floor drain in addition to the role of drainage to meet outside, it needs to be able to put the living space and plumbing systems are separated so that odor and overflow will not run up the pipeline as an important component of residential drainage systems, floor drain performance a direct impact on indoor air quality, and human health are closely related.

These and other objects and advantages of the invention will become apparent from the following description and from the accompanying drawings which illustrate one embodiment of the invention.

SUMMARY OF THE INVENTION

According to an embodiment of the present invention, there is disclosed a system for inserting a removable drain valve within an inlet opening of a drain basin and then sealing the drain valve within the drain basin. The removable drain valve has a cylindrical housing with a check valve disposed within an outlet of the drain basin to allow drain water to flow out from the outlet of the drain basin while blocking flow from the outlet of the drain basin to the inlet of the drain basin. A cylindrical expander band having first and second ends spaced from each other is disposed about the cylindrical housing. A cylindrical gasket is mounted about the cylindrical housing and the cylindrical expander band. A paddle lock lever is pivotally mounted within the cylindrical housing. The paddle lock lever has an expander head to expand the cylindrical expander band and cause the cylindrical gasket to expand and seal against the drain basin.

According to another embodiment of the present invention, there is disclosed a removable drain valve for insertion within an inlet opening of a drain basin. The removable drain valve has a cylindrical housing with a check valve disposed within an outlet of the drain basin to allow drain water to flow out from the outlet of the drain basin while blocking flow from the outlet of the drain basin to the inlet of the drain basin. A cylindrical expander band disposed about the cylindrical housing having first and second ends spaced from each other. A cylindrical gasket mounted about the cylindrical housing and the cylindrical expander band. A paddle lock lever pivotally mounted within the cylindrical housing. First and second connecting rods are each mounted at an outer end to the first and second ends of the cylindrical expander band and at an inner end to the paddle lock lever whereby movement of the paddle lock lever can expand the cylindrical expander band and cause the cylindrical gasket to expand and seal against the drain basin.

According to another embodiment of the present invention, there is disclosed a method of operating a removable drain valve a drain basin. The method includes: a) providing the removable drain valve having a cylindrical housing with a check valve; b) providing a paddle lock lever pivotally mounted within the cylindrical housing having an open position where the cylindrical expander band is biased to a contracted condition and a closed position where the cylindrical expander band is expanded; c) mounting a cylindrical gasket constructed of an elastic material about the cylindrical housing to bias the cylindrical expander band into the contracted condition; d) moving the paddle lock lever to the open position whereby the drain valve can be inserted into the drain basin; and e) moving the paddle lock lever to the closed position where the cylindrical expander band expands and causes the cylindrical gasket to expand and seal against the drain basin.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
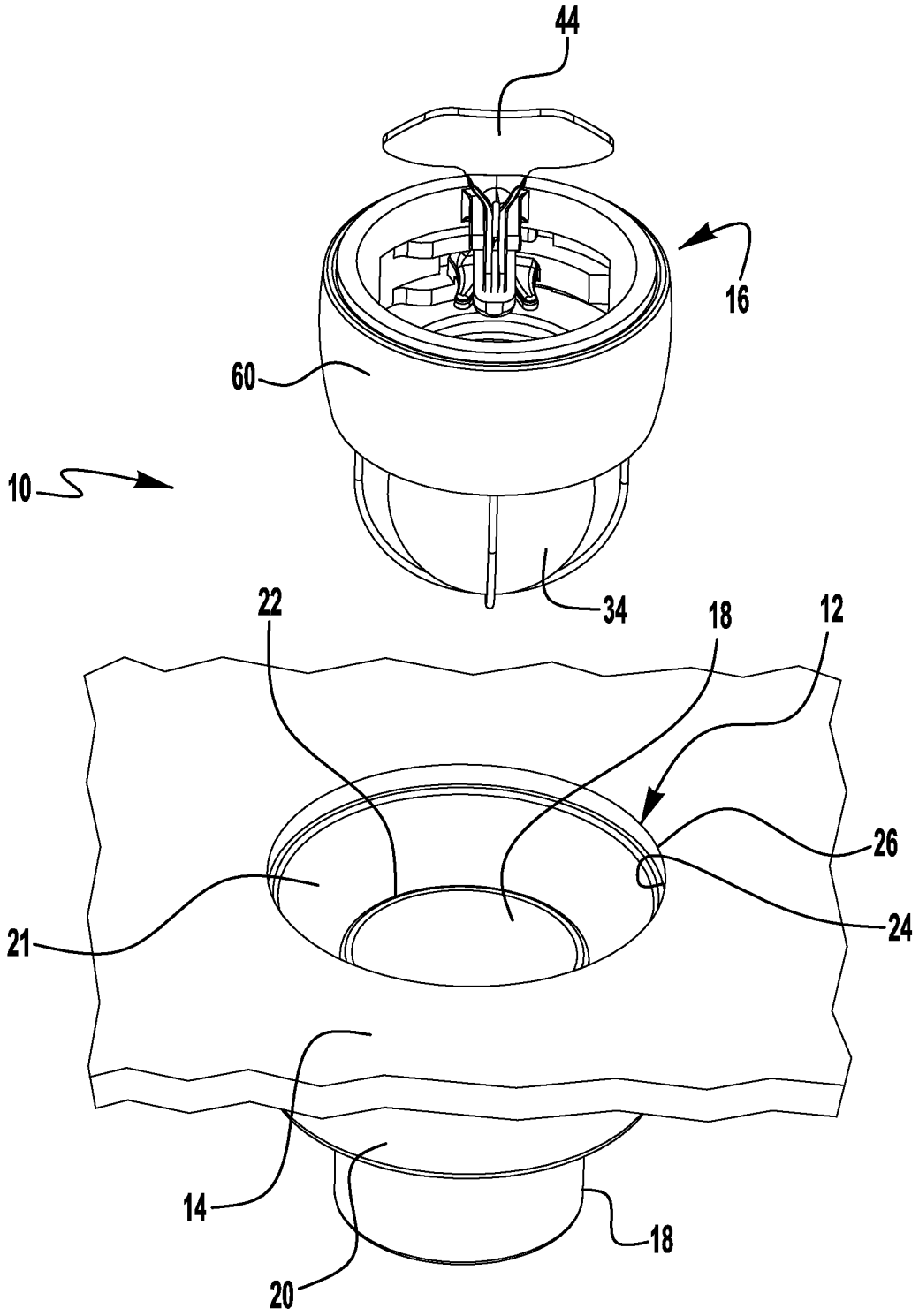
FIG. 1 is a three-dimensional, side view of a check valve floor drain disposed above the floor drain into which it will be mounted, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

A basic problem with residential and commercial plumbing systems is the back flow of sewage and drain water into the plumbing fixtures of a sewage generating facility due to a blockage or an obstruction of the sewer line. This problem is amplified where the sewage generating facility comprises an apartment building, an office building, or a similar multi-unit structure having a large number of drain fixtures therein. Hospitals, food handling or food service establishments and like structures are of particular concern because the back flow of any sewage into such facilities presents even greater opportunity for serious health hazards. Such flooding is not only unsanitary but can cause considerable damage to the building and contents therein.

Referring to FIG. 1, there is illustrated a floor drain assembly 10 including a floor drain 12 disposed in a floor 14, such as a building floor, a basement, a garage floor, an exterior paved area and the like and a removable drain valve 16 designed to be removably insertable within a drain basin 20. The removable drain valve 16 is provided to prevent water backflow, trap water evaporation and sewer gas seepage through the drain basin 20 while still allowing free drainage function through a standard size drain pipe 18 extending downward from the outlet 22 of the drain basin 20. The drainpipe 18 is a pipe or tube that acts as a conduit between a house (or business) and the sewer system. The removable drain valve 16 can be removed from its operative location within interior sidewall 21 of the drain basin 20 for cleaning, inspection or testing, and repair of the floor drain assembly 10. The drain valve 10 may be constructed of any material, such as plastic or stainless steel for corrosion resistance. Typically, a grate cover or strainer (not shown) is seated within a groove 24 formed around the inlet 26 of the drain basin 20. The strainer is placed atop the drain basin 20 within the groove 24, such that it is flush with the floor 14. The purpose of the strainer is to strain or filter out solid debris in water before entering the removable drain valve 16 to avoid damage to the drainpipe 18 and other parts of the sewer system.

Figure 2:
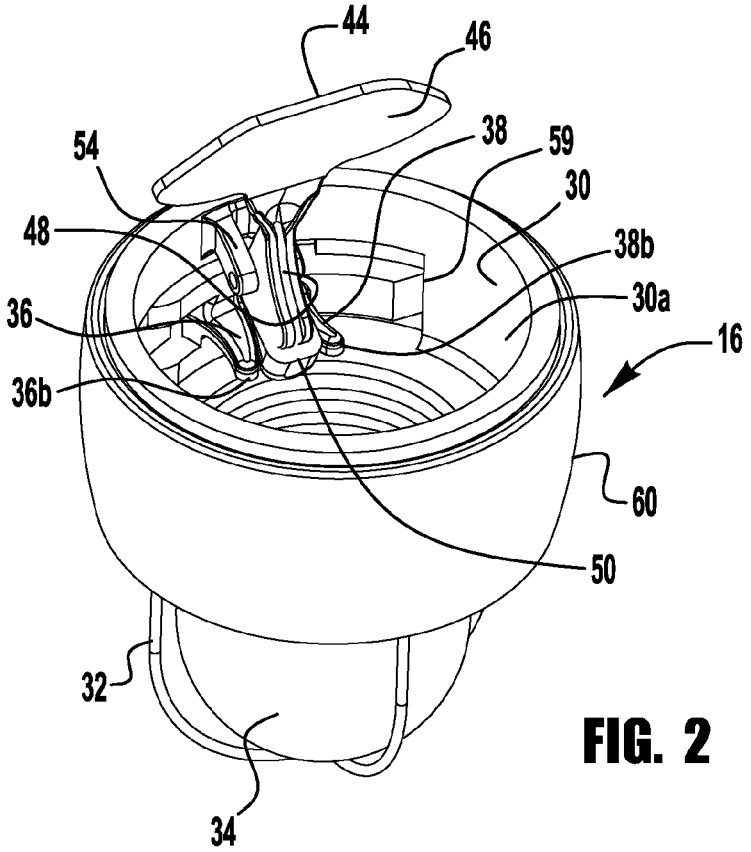
FIG. 2 is a three-dimensional side view of the check valve floor drain in an open condition, in accordance with the present invention.

Referring to FIG. 2, there is illustrated the removable drain valve 16 in an open condition where it is in a contracted state so as to be able to be inserted within the drain basin 20 adjacent the interior wall 21. Removable drain valve 16 includes a cylindrical housing 30 with a cage 32 containing a ball valve 34 mounted within the outlet 22 of the drain basin 20. A washer 35 can be mounted to the outlet 31 of the cylindrical housing 30 to provide a seat for the ball 34.

The ball valve 34 acts as a check valve that normally allows fluid (liquid or gas) to flow through it in only one direction. Check valves are two-port valves, meaning they have two openings in the body, one for fluid to enter and the other for fluid to leave. Any type of check valve may be used, such as a ball check valve 34 illustrated in FIG. 1.

A ball check valve is used to regulate fluid flow by allowing flow in one direction while blocking flow in the opposite direction. Typically, a check ball valve includes a check ball 34 and a ball seat 35, see FIG. 5. Normally when drain water flow down into the inlet 26 of the drain basin 20, the check ball 34 sits at the bottom of the cage 32 and allows the drain water to flow from the outlet opening 22 of the drain basin 20 and through the drainpipe 18.

When pressurized fluid flows in the opposite direction, i.e., through the outlet opening 22, the check ball 34 is forced against the ball seat 35, sealing off any opening for fluid to pass around the ball. The ball seat 35 may be an O-ring seal forming a ball seat into which the ball 34 makes contact. The ball 34 is further contained in the fluid passage by a cage 32 that holds the ball while otherwise providing an open cross-sectional area to allow the pressurized fluid to flow from the outlet opening 22.

Figure 3:
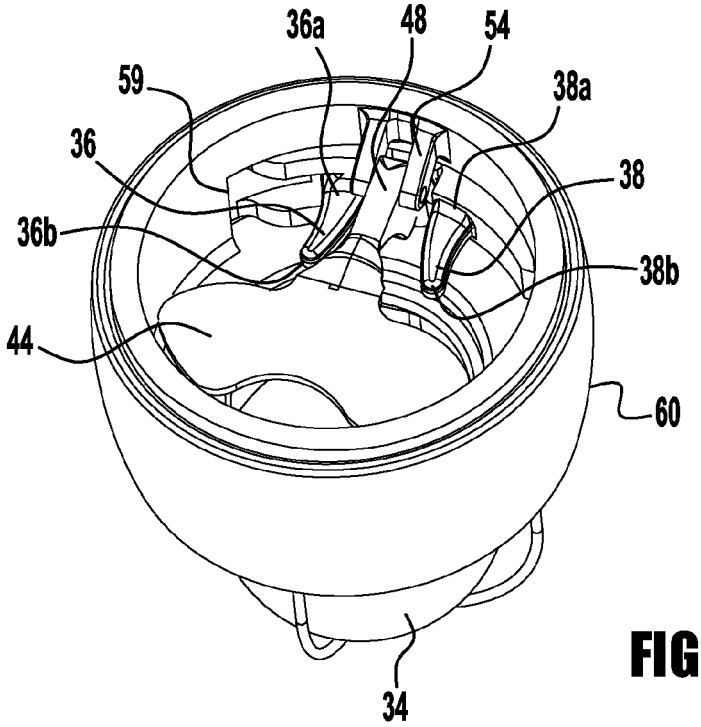
FIG. 3 is a front three-dimensional top view of the check valve floor drain in a closed condition, in accordance with the present invention.
Figure 4:
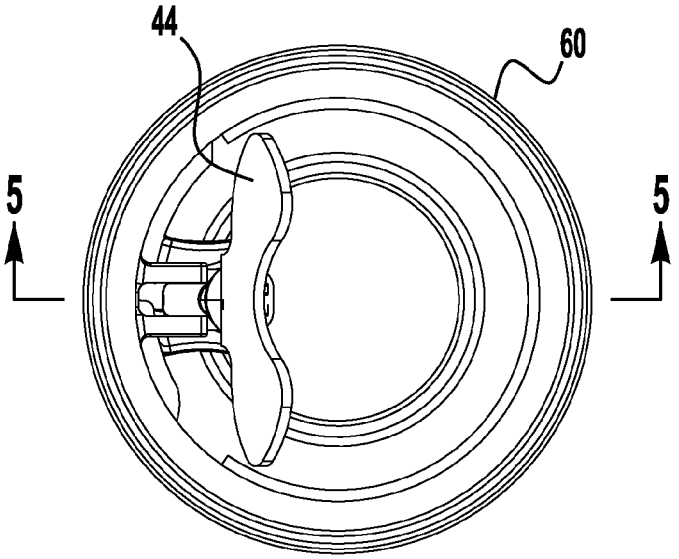
FIG. 4 is a top view of the check valve floor drain in an open condition, in accordance with the present invention.
Figure 6:
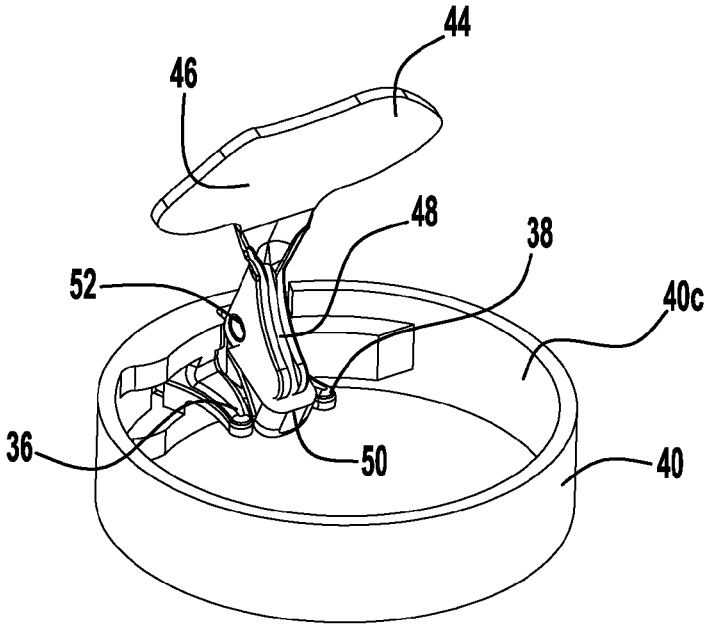
FIG. 6 is a three-dimensional front view of the inner part of the check valve floor drain in an open condition, in accordance with the present invention.
Figure 7:
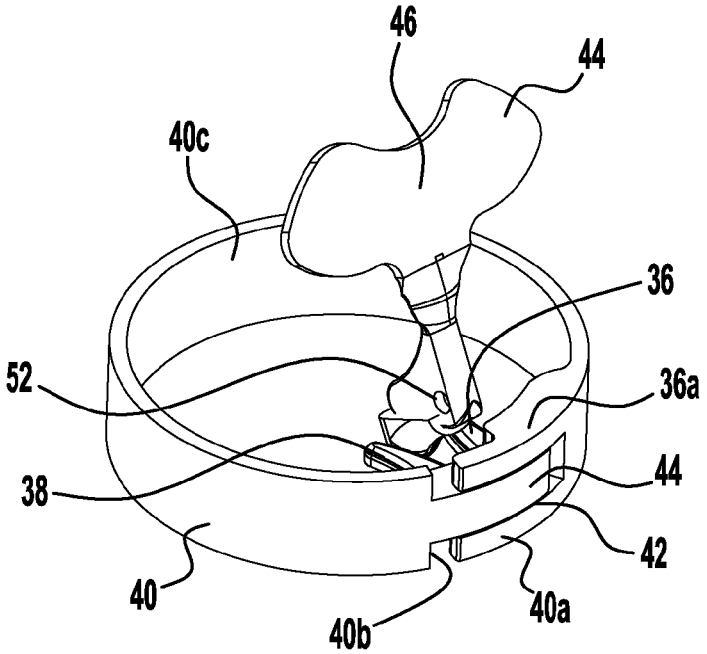
FIG. 7 is a three-dimensional rear view of the inner part of the check valve floor drain in an open condition, in accordance with the present invention.

Referring to FIGS. 2 and 3, a pair of horn shaped expanders 36 and 38 are mounted at their inner ends 36*a* and 38*a*, respectively, the ends 40*a* and 40*b* of a cylindrical expander band 40. The free ends 36*b* and 38*b* of the horn shaped expanders 36 and 38 and extend into and towards the center of the cylindrical band 40. As shown in FIGS. 2 and 3, the distance between the outer ends 36*b* and 38*b* of the horn shaped expanders 36 and 38 is greater than the distance between the inner ends 36*a* and 38*a* mounted to the cylindrical expander band 40. As shown in FIG. 7, one end 40*a* of the band 40 has a slot 42 which opens at the free end of the band. The opposite end 40*b* of the band 40 has a tongue 44 which is movably received within the slot 42 and moves within the slot when the band expands and the end 40*a* and 40*b* separate from each other as discussed hereinafter. The band 40 can be constructed of a springy material, such as metal or plastic, and is biased to the contracted condition, i.e. with the smallest diameter as shown in FIGS. 6 and 7. Expander 36 is mounted at end 36*a* to the inner surface 40*c* of the band 40 near the end 40*a*. Expander 38 is mounted on the inner surface of tongue 44.

A paddle lock lever 44 has a hand operator 46 at one end, an expander head 50 at an opposite end and a connector 48 mounted at one end to the hand operator and at the opposite end to the expander head 50. The connector 48 has a pivot mount 52 for pivotally securing the paddle lock lever 44 to a pivot anchor 54, see FIGS. 2 and 3, secured to the interior wall 30*a* of the cylindrical housing 30. The housing 30 includes a groove 56 extending around an exterior wall 30*b* as shown in FIG. 5.

As shown in FIGS. 1-3, a cutout 59 is formed through the wall of the cylindrical housing 30 to receive the horn shaped expanders 36 and 38 and the slot 42 and tongue 44 of the cylindrical expander band 40 to allow for the expansion of the expander band when the expander head 50 is pressed between the horn shaped expanders 36 and 38.

Figure 5:
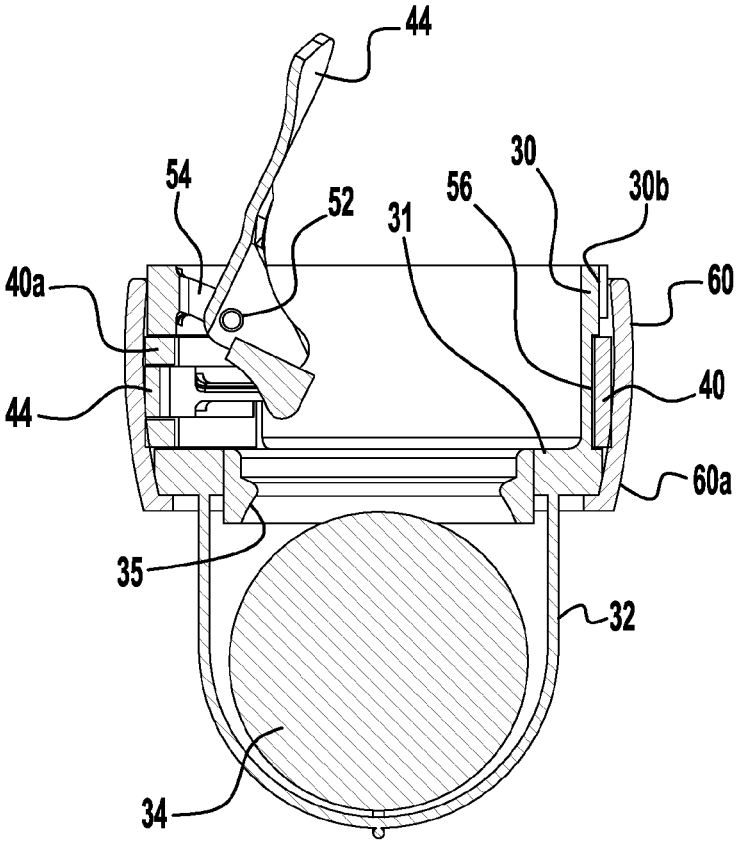
FIG. 5 is a side, cross sectional view through line 5-5 of FIG. 4, in accordance with the present invention.

A cylindrical gasket 60 can be mounted about the cylindrical housing 30 as shown in FIG. 5. The gasket 60 will typically be secured to the cylindrical housing 30 near the bottom 60*a* of the gasket by any means such as a cylindrical clip (not shown). The cylindrical gasket 60 can be constructed of an elastic material, such as an elastomeric type polymer like rubber, and tightly fit around the cylindrical housing 30 and the cylindrical expander band 40 to bias the cylindrical band into the contracted condition. When the cylindrical expander band 40 is expanded by pushing the paddle lock lever 44 down, the expander head 50 is pressed between the expanders 36 and 38 causing the tongue 44 to move within the slot 42 so that the band expands and the ends 40*a* and 40*b* of the band separate from each other. The expansion of the band 40 causes the cylindrical gasket 60 to expand and seal against the interior sidewall 21 of the drain basin 20.

In operation, the removable drain valve 16 is inserted within the drain basin 20, as shown in FIG. 1. Note that during the insertion of the drain valve 16 into the drain basin 20, the paddle lock lever 44 is in the open position with the band 40 biased in the contracted condition, i.e. with the smallest diameter, as shown in FIGS. 1 and 2. Once the drain valve is 16 inserted into the drain basin 20 while still in the contracted condition, the paddle lock lever 44 is pushed down, as shown in FIG. 3, causing the band 40 to expand, i.e. to increase in diameter. The expansion of band 40 causes the cylindrical gasket 60 to expand and seal against the interior sidewall 21 of the drain basin 20.

Figure 8:
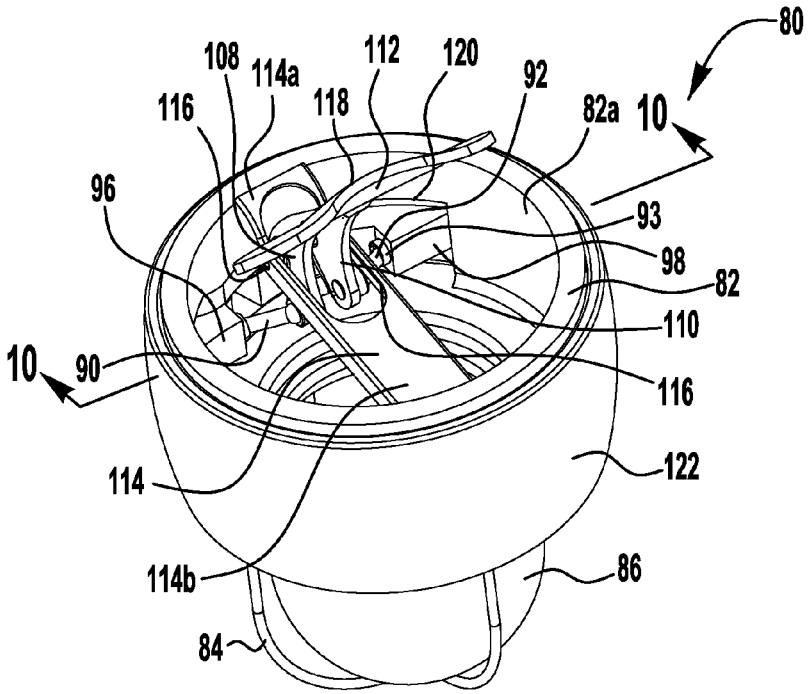
FIG. 8 is a three-dimensional side view of a second embodiment of the check valve floor drain in an open condition, in accordance with the present invention.
Figure 9:
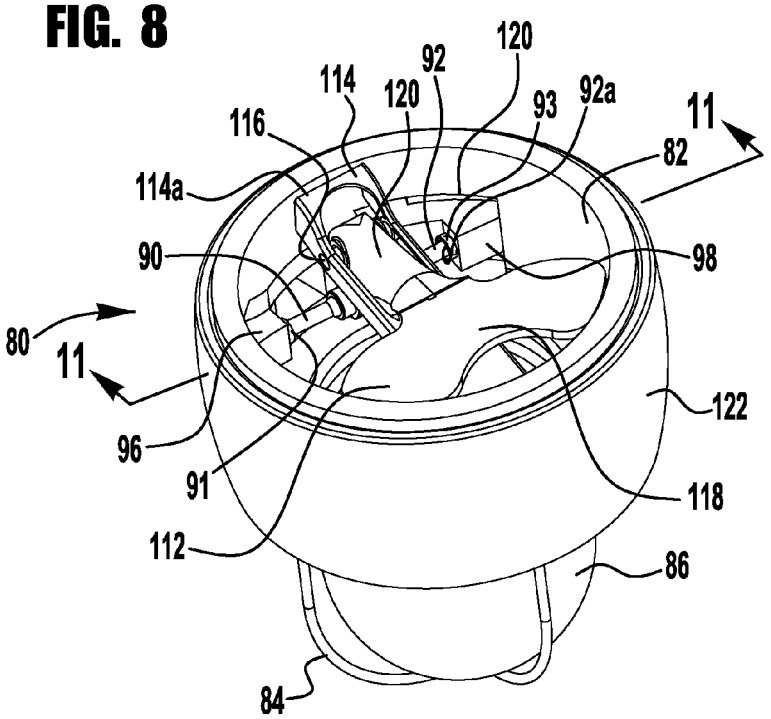
FIG. 9 is a front three-dimensional top view of a second embodiment of the check valve floor drain in a closed condition, in accordance with the present invention.

Referring to FIG. 8, there is shown a second embodiment of a removable drain valve 80 in an open condition where it is able to be inserted within the drain basin 20, compare to FIG. 1, so as to facilitate sealing against the interior wall 21 of the drain valve. Removable drain valve 80 includes a cylindrical housing 82 with a cage 84 containing a ball valve 86 mounted to the outlet 83 of the housing. A washer 88 can be mounted to the outlet 83 to provide a seat for the ball 86.

The ball valve 86 acts as a check valve that allows fluid (liquid or gas) to flow through it in only one direction. Any type of check valve may be used, such as a ball check valve 86 illustrated in FIG. 8. Normally when drain water flows down into the inlet 26 of the drain basin 20, the check ball 86 sits at the bottom of the cage 84 and allows the drain water to flow from the outlet opening 22 of the drain basin.

When pressurized fluid flows in the opposite direction, through the outlet opening 22, the check ball 86 is forced against the ball seat 88, sealing off any opening for fluid to pass around the ball. The ball 86 is further contained in the fluid passage by a cage 84 that holds the ball while otherwise providing an open cross-sectional area to allow the fluid to flow from the outlet opening 22.

Figure 10:
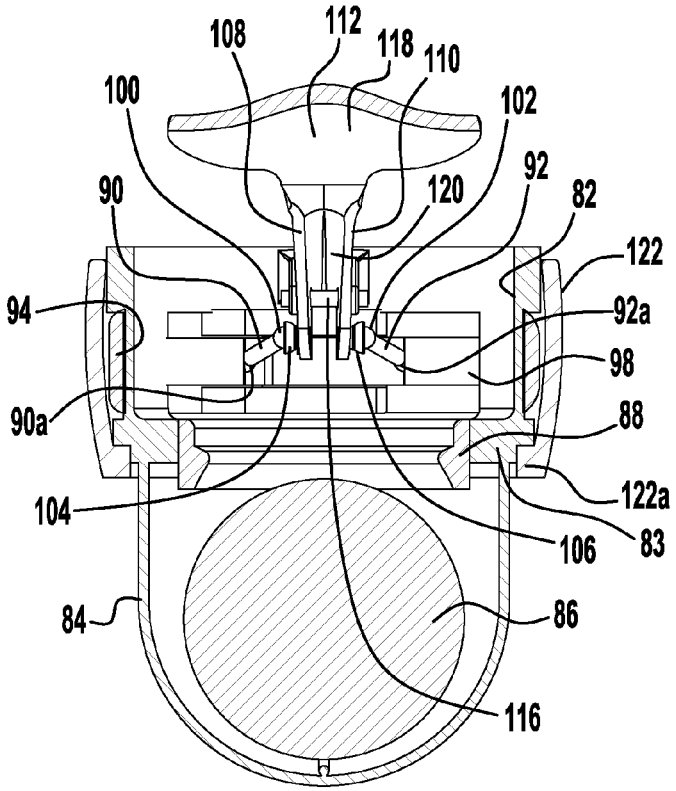
FIG. 10 is a side, cross sectional view through line 10-10 of FIG. 8, in accordance with the present invention.

Referring to FIGS. 8-11, a pair of connecting rods 90 and 92 are mounted at outer ends 90*a* and 92*a*, respectively, to a cylindrical expander band 94 (compare band 40 in FIG. 6). The outer ends 90*a* and 92*a* of the connector rods 90 and 92 can be balls that are rotatably mounted in a socket 91 and 93 which in turn are mounted to support anchors 96 and 98 that form an integral part of the band 94. In the same manner as shown in FIG. 7, one end of the band 94 forms a slot (not shown) which opens at the free end of the band. The opposite end 94*b* of the band 90 has a tongue which is movably received within the slot and moves within the slot when the band expands and the ends (not shown) separate from each other as discussed hereinafter. The band 90 can be constructed of a spring material, such as metal or plastic, and is biased to the contracted condition, i.e. with the smallest diameter as shown in FIGS. 8 and 10.

The inner ends 100 and 102 of connecting rods 90 and 92 are preferably balls rotatably mounted to a socket 104 and 106, respectively, that are secured to the sides 108 and 110, respectively, of a paddle lock lever 112. The paddle lock lever 112 is pivotally mounted to a support 114 by a pivot pin 116, see FIG. 10, which is supported by each side 108 and 110 of a connector 120 of the paddle lock lever 112. The connector 120 of paddle lock lever 112 has a hand operator 118 at one end and is pivotally mounted by pivot pin 116 at the opposite end to the support 114.

The support 114 is secured at opposite ends 114*a* and 114*b* to the cylindrical housing 82. The support 114 spans the inner diameter of the cylindrical housing 82 to ensure that the paddle lock lever 112 of the removable drain valve 80 is pivotally secured within cylindrical housing 82.

The cylindrical housing 82 includes a cutout 120 extending around a portion of the interior wall 82*a* which receives the support anchors 96 and 98 that form an integral part of the band 94. The cutout 120 allows the connecting rods 90 and 92 to move the support anchors 96 and 98 when the paddle lock lever 112 is moved from the open position shown in FIGS. 8 and 10 to the closed position shown in FIGS. 9 and 11.

Figure 11:
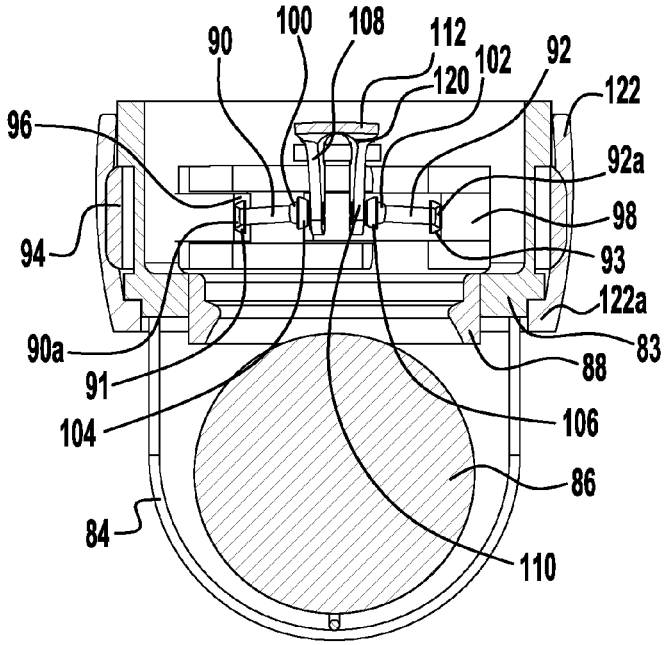
FIG. 11 is a side, cross sectional view through line 11-11 of FIG. 9, in accordance with the present invention.

A cylindrical gasket 122 can be mounted about the cylindrical housing 82 as shown in FIGS. 8-11. The gasket 122 will typically be mounted to the cylindrical housing 82 near the bottom 122*a* by any means such as a cylindrical clip (not shown). The cylindrical gasket 122 can be constructed of an elastic material, such as an elastomeric type polymer like rubber, and tightly fit around the cylindrical housing 82 and the cylindrical expander band 94 to bias the cylindrical band into the contracted condition as shown in FIG. 10. When the cylindrical expander band 94 is expanded by pushing the paddle lock lever 112 down into the closed position, the connecting rods 90 and 92 move outwards, as shown in FIG. 11, to move the support anchors 96 and 98 causing the expander band 94 to expand. Note that the ends of the expander band 94 separate from each other. The expansion of the band 94 causes the cylindrical gasket 122 to expand, as shown in FIG. 11, and seal against the interior sidewall 21 of the drain basin 20.

In operation, in a similar fashion to the installation of the removable drain valve 16 within the drain basin 20 as shown in FIG. 1, the removable drain valve 80 is installed within the drain basin 20. Note that the paddle lock lever 112 is in the open position with the expander band 94 biased in the contracted condition, i.e. with the smallest diameter, as shown in FIG. 10. Once the drain valve is seated into the contracted condition, the paddle lock lever 112 is pushed down as shown in FIG. 11 causing the band 94 to expand, i.e. to increase in diameter. The expansion of band 94 causes the cylindrical gasket 122 to expand and seal against the interior sidewall 21 of the drain basin 20.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A removable drain valve for insertion within an inlet opening of a drain basin;

the removable drain valve having a cylindrical housing with a check valve disposed with an outlet of the drain basin to allow drain water to flow out from the outlet of the drain basin while blocking flow from the outlet of the drain basin to an inlet of the drain basin;

a cylindrical expander band disposed about the cylindrical housing having first and second ends spaced from each other;

a cylindrical gasket mounted about the cylindrical housing and the cylindrical expander band; and a paddle lock lever pivotally mounted within the cylindrical housing, the paddle lock lever having an expander head to expand the cylindrical expander band and cause the cylindrical gasket to expand and seal against the drain basin.

2. The removable drain valve of claim 1 wherein:

the check valve includes a cage containing a ball valve mounted to the outlet of the drain basin; and a washer mounted to the outlet of the drain basin to provide a seat for the ball.

3. The removable drain valve of claim 1 wherein:

the paddle lock lever includes a connector mounted at one end to a hand operator and at an opposite end to the expander head; and the connector having a pivot mount for pivotally securing the paddle lock lever to a pivot anchor secured to an interior wall of the cylindrical housing.

4. The removable drain valve of claim 1 wherein:

the cylindrical expander band includes a slot formed in the first end of the band and a tongue formed at the second end of the band which is movably received within the slot when the band expands and the first and second ends of the band separate from each other.

5. The removable drain valve of claim 4 further including:

first and second horn shaped expanders each mounted at an inner end to the first and second ends of the cylindrical expander band, said first and second horn shaped expanders each having an outer end extending into and towards the center of the cylindrical band.

6. The removable drain valve of claim 5 wherein a distance between the outer ends of the first and second horn shaped expanders, respectively, is greater than a distance between the inner ends of the first and second horn shaped expanders mounted to the cylindrical expander band.

7. The removable drain valve of claim 1 wherein:

the cylindrical band is in a contracted condition when the drain valve is inserted within the drain basin; and the cylindrical band is in an expanded condition when the drain valve is sealed within the drain basin.

8. The removable drain valve of claim 7 wherein:

the cylindrical band is constructed of a springy material and is biased to the contracted condition.

9. The removable drain valve of claim 8 wherein the cylindrical gasket is constructed of an elastic material and tightly fits around the cylindrical housing and the cylindrical expander band to bias the cylindrical expander band into the contracted condition.

10. A removable drain valve for insertion within an inlet opening of a drain basin;

the removable drain valve having a cylindrical housing with a check valve disposed with an outlet of the drain basin to allow drain water to flow out from the outlet of the drain basin while blocking flow from the outlet of the drain basin to an inlet of the drain basin;

a cylindrical expander band disposed about the cylindrical housing having first and second ends spaced from each other;

a cylindrical gasket mounted about the cylindrical housing and the cylindrical expander band; and a paddle lock lever pivotally mounted within the cylindrical housing;

first and second connecting rods each mounted at an outer end to the first and second ends of the cylindrical expander band and at an inner end to the paddle lock lever whereby movement of the paddle lock lever can expand the cylindrical expander band and cause the cylindrical gasket to expand and seal against the drain basin.

11. The removable drain valve of claim 10 wherein:

the paddle lock lever includes a connector mounted at one end to a hand operator and pivotally mounted at an opposite end to an interior wall of the cylindrical housing.

12. The removable drain valve of claim 11 wherein:

the outer end of the first and second connecting rods is a ball and the inner end of the first and second connecting rods is a ball.

13. The removable drain valve of claim 12 wherein:

the outer ball forming outer end of the of the first and second connecting rods are each mounted into a socket mounted in first and second support anchors which are rotatably mounted at the first and second ends of the cylindrical expander band; and the inner ball forming inner end of the of the first and second connecting rods are each rotatably mounted into first and second sockets mounted in the connector of the paddle lock lever.

14. The removable drain valve of claim 13 wherein:

the cylindrical band is constructed of a springy material and is biased to the contracted condition when the drain valve is inserted within the drain basin.

15. The removable drain valve of claim 14 wherein:

the cylindrical band is in an expanded condition when the drain valve is sealed within the drain basin.

16. The removable drain valve of claim 15 wherein the cylindrical gasket is constructed of an elastic material and tightly fits around the cylindrical housing and the cylindrical expander band to bias the cylindrical expander band into the contracted condition.

17. The removable drain valve of claim 16 wherein:

the cylindrical expander band includes a slot formed in the first end of the band and a tongue formed at the second end of the band which is movably received within the slot when the band expands and the first and second ends of the band separate from each other.

18. The removable drain valve of claim 10 wherein:

the check valve includes a cage containing a ball valve mounted to the outlet of the drain basin; and a washer mounted to the outlet of the drain basin to provide a seat for the ball.

19. The method of operating a removable drain valve a drain basin; comprising:

providing the removable drain valve having a cylindrical housing with a check valve;

mounting a cylindrical gasket constructed of an elastic material about the cylindrical housing to bias a cylindrical expander band into the contracted condition;

providing a paddle lock lever pivotally mounted within the cylindrical housing having an open position where the cylindrical expander band is biased to a contracted condition and a closed position where the cylindrical expander band is expanded;

moving the paddle lock lever to the open position whereby the drain valve can be inserted into the drain basin; and moving the paddle lock lever to the closed position where the cylindrical expander band expands and causes the cylindrical gasket to expand and seal against the drain basin.

20. The method of claim 19 including:

moving the paddle lock lever to an open position where the ends of the cylindrical expander band are moved towards each other and the cylindrical expander band is in a contracted condition; and moving the paddle lock lever to a closed position where the ends of the cylindrical expander band are moved away from each other whereby the cylindrical expander band is in an expanded condition.

* * * * *